United States Patent [19]

Fringeli et al.

[11] 4,339,238

[45] Jul. 13, 1982

[54] STABLE AQUEOUS FORMULATIONS OF STILBENE FLUORESCENT WHITENING AGENTS

[75] Inventors: Werner Fringeli, Laufen, Switzerland; Alain Lauton, Saint-Louis, France

[73] Assignee: Ciba-Geigy Corporation, Ardsley, N.Y.

[21] Appl. No.: 223,173

[22] Filed: Jan. 7, 1981

[30] Foreign Application Priority Data

Jan. 14, 1980 [CH] Switzerland ..... 265/80

[51] Int. Cl.[3] ..... C09K 11/06; D06P 3/852; D21D 3/00; D21H 3/80

[52] U.S. Cl. ..... 8/527; 8/532; 8/533; 8/584; 8/648; 252/301.23; 162/158; 162/162

[58] Field of Search ..... 8/584, 648, 532, 533; 252/301.23; 162/158, 179, 162

[56] References Cited

U.S. PATENT DOCUMENTS

| | | | |
|---|---|---|---|
| 2,956,898 | 10/1960 | Fleck | 8/648 |
| 3,529,922 | 9/1970 | Berger et al. | 8/54 |
| 3,600,385 | 8/1971 | Loffelman et al. | 8/648 |
| 3,672,816 | 6/1972 | Dehnert | 8/648 |
| 3,765,831 | 10/1973 | Senez | 8/54 |
| 3,900,608 | 9/1975 | Dierkes et al. | 8/648 |
| 4,258,448 | 3/1981 | Keitz et al. | 8/584 |

FOREIGN PATENT DOCUMENTS

| | | | |
|---|---|---|---|
| 813769 | 5/1969 | Canada | 8/648 |
| 43-27144 | 11/1968 | Japan | 8/584 |
| 49-30866 | 8/1974 | Japan | 8/584 |
| 1453261 | 10/1976 | United Kingdom . | |
| 2002426 | 2/1979 | United Kingdom . | |

*Primary Examiner*—Maria Parrish Tungol
*Attorney, Agent, or Firm*—Edward McC. Roberts

[57] ABSTRACT

The invention relates to formulations which are stable to metal ions and contain a stilbene fluorescent whitening agent which is substituted by sulfo groups, and an acid phosphoric acid ester of an oxyalkylated fatty amine of the formula

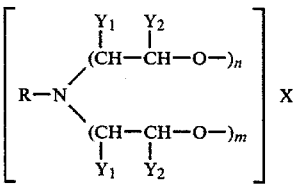

wherein R is an aliphatic hydrocarbon radical of 8 to 22 carbon atoms, $Y_1$ and $Y_2$ are preferably hydrogen, X is the acid radical of phosphoric acid and the sum of n+m is 2 to 30, preferably 4 to 20. The formulations can additionally contain various assistants such as non-ionic or anionic surfactants and/or organic solvents or polar compounds. The formulations are used for whitening natural and synthetic fabrics, e.g. made from polyamide, cellulose and blended fabrics, as well as paper.

14 Claims, No Drawings

STABLE AQUEOUS FORMULATIONS OF STILBENE FLUORESCENT WHITENING AGENTS

The present invention relates to aqueous storable formulations of fluorescent whitening agents of the stilbenesulfonic acid type, which formulations are stable to metal ions and, consequently, also to metal catalysts, to the use of said formulations for whitening natural and synthetic fabrics or paper, and to a bath which contains said formulations.

Solutions or formulations of fluorescent whitening agents of the stilbenesulfonic acid type are unstable in the presence of metal ions and/or metal catalysts. Troublesome metal ions are, in particular, alkaline earth metal ions and heavy metal ions. On the one hand, such ions (calcium, magnesium) come in contact with the fluorescent whitening agents when using non-softened water for preparing or diluting solutions, for which reason it has not been possible up to now to prepare stable formulations of such stilbene fluorescent whitening agents, or baths containing these latter, with ion-containing water. On the other hand, heavy metal ions, and also magnesium ions, are introduced into baths containing stilbene fluorescent whitening agents by adding crosslinking catalysts for textile finishing, e.g. $MgCl_2$, $ZnCl_2$ etc., whereupon the fluorescent whitening agent often precipitates from these baths.

A method of whitening nitrogen-containing fabrics and cellulosic fabrics with stilbene fluorescent whitening agents using specific oxyalkylated fatty amines, by means of which method the disadvantages referred to above can be partly avoided, is known from British Pat. No. 1 453 261.

Surprisingly, it has now been found that these disadvantages can be almost completely overcome by adding, as stabilising assistant, an acid phosphoric acid ester of a specific oxyalkylated fatty amine to the formulations or baths containing fluorescent whitening agent. In addition, the formulations and baths so obtained are stable to acid, which is of great advantage in many methods of application.

The formulations of this invention are of excellent stability, even if ion-containing water (mains water) has been used to prepare them. In addition, they can support a high concentration of fluorescent whitening agent, whereby they also assume particular importance as commercial formulations. The stability of these formulations can be increased by the addition of further assistants.

The storable aqueous formulations of this invention which are stable to metal ions contain a stilbene fluorescent whitening agent which is substituted by sulfo groups, and an acid phosphoric acid ester of an oxyalkylated fatty amine of the formula

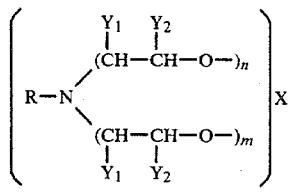

(1)

or an alkali metal salt, ammonium salt or amine salt thereof, wherein R is an aliphatic hydrocarbon radical of 8 to 22 carbon atoms, $Y_1$ and $Y_2$ are both hydrogen, or one of $Y_1$ and $Y_2$ is hydrogen and the other is methyl, X is the acid radical of phosphoric acid, the acid hydrogen atoms of which radical can be replaced by alkali metal ions, ammonium ions or amine salt ions, and m and n are integers, the sum of which is 2 to 30.

In formula (1), the aliphatic radical R is preferably a branched or unbranched alkyl or alkenyl radical of 10 to 22 carbon atoms, and the sum of n+m is preferably 4 to 20, most preferably 6 to 8. The preferred identity of $Y_1$ and $Y_2$ is hydrogen.

The most preferred assistants of the formula (1) are those in which R is the lauryl radical ($C_{12}H_{25}$) and the sum of n+m is 8.

The radical R generally does not have to contain a specific number of carbon atoms, but can also be a mixture of hydrocarbon chains of different length such as many fatty amines which are derived from natural fats have. A further preferred radical of this kind is the hydrocarbon radical of tallow fatty amine.

The acid component of the ester of formula (1) is phosphoric acid. X is therefore the radical of phosphoric acid, whilst the terminal OH groups of the ethylene oxide or propylene oxide chains can be completely or only partially esterified. The number of acid hydrogen atoms in the phosphoric acid radical X is contingent on the degree of esterification, which need not be a whole number. These acid hydrogen atoms can also be replaced by alkali metal ions, ammonium ions or amine salt ions, so that the radical X is in salt form. However, it is preferred that the radical X is in its acid form.

Depending on the degree of esterification, possible structures of compounds of the formula (1) are for example ($Y_1$ and $Y_2$=H):

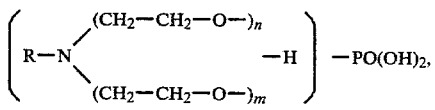

(1a)

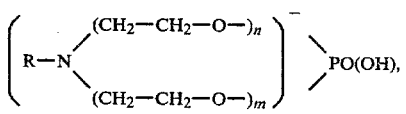

(1b)

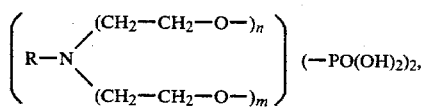

(1c)

-continued

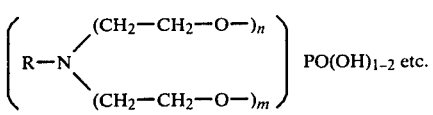

(1d)

Suitable stilbene fluorescent whitening agents in the formulations of the invention are, in particular, those of the bis-triazinylstilbene-disulfonic acid type, of the bis-styrylbiphenyl type, or of the bis-triazolylstilbene-disulfonic acid type. Typical examples of such fluorescent whitening agents are compounds of the formula

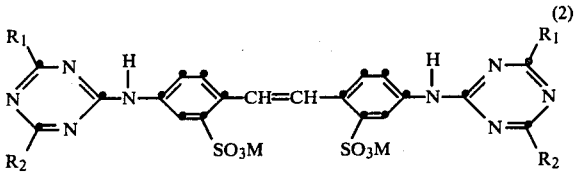

(2)

wherein M is hydrogen, or an alkali metal ion, ammonium ion or amine salt ion, and $R_1$ and $R_2$ are $NH_2$, $NH—CH_3$, $NH—C_2H_5$, $N(CH_3)_2$, $N(C_2H_5)_2$, $NH—CH_2—CH_2—OH$, $NH—CH_2—CH_2—CH_2—OH$, $N(CH_2—CH_2—OH)_2$, $N(CH_2—CH_2—CH_2—OH)_2$, $N(CH_3)(CH_2—CH_2—OH)$, $NH—CH_2—CH_2—O—CH_2—CH_2—OH$, $NH—CH_2—CH_2—SO_3M$, OH, $OCH_3$, $OCH(CH_3)_2$, $O—CH_2—CH_2—O—CH_3$,

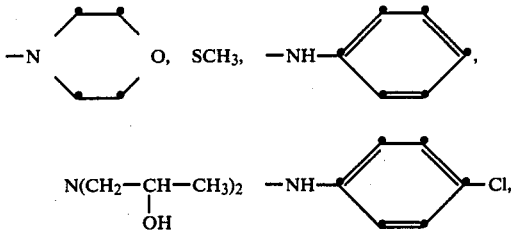

those of the formula

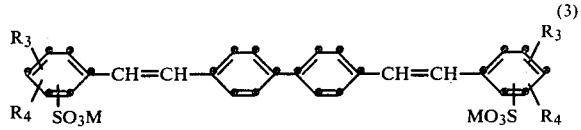

(3)

wherein $R_3$ is hydrogen, alkyl of 1 to 4 carbon atoms, alkoxy of 1 to 4 carbon atoms, halogen or $SO_3M$, $R_4$ is hydrogen or alkyl of 1 to 4 carbon atoms, and M is hydrogen or an alkali metal ion, ammonium ion or amine salt ion; and those of the formula

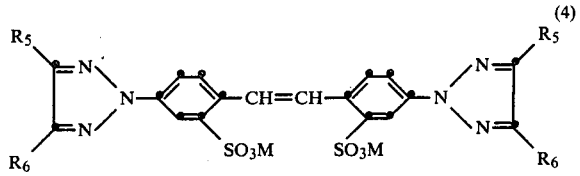

(4)

wherein M is hydrogen, an alkali metal ion, ammonium ion or amine salt ion, and each of $R_5$ and $R_6$ independently is hydrogen, $CH_3$,

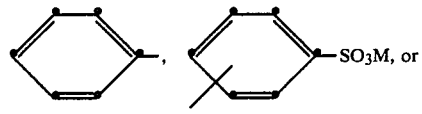

$R_5$ and $R_6$ together complete or $R_5$ and $R_6$ together complete a benzene ring. The formulations can also contain a mixture of the above fluorescent whitening agents, e.g. a mixture of different bis-styrylbiphenyl compounds of the formula (3). For example, such a mixture can consist of 4,4'-bis-(2-sulfostyryl)biphenyl and 4,4'-bis-(3-sulfo-4-chlorostyryl)-biphenyl or salts thereof.

Preferred formulations contain, as stilbene fluorescent whitening agents, those of the formula

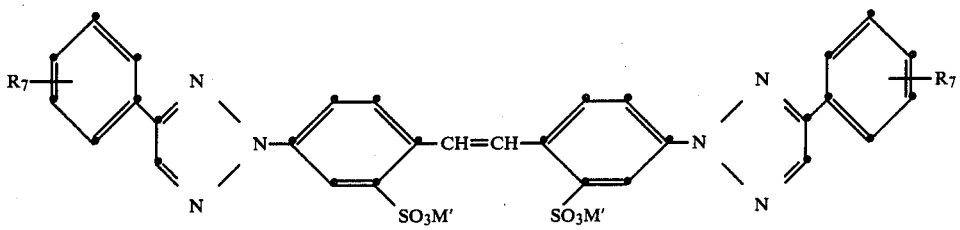

(5)

wherein $R_7$ is hydrogen or $—SO_3M'$ and M' is hydrogen, or a sodium, potassium, ammonium or amine salt ion, and those of the formula

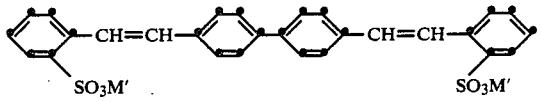

(6)

wherein M' is hydrogen, or a sodium, potassium, ammonium or amine salt ion.

The sulfo group —$SO_3M$ in compounds of the formula (2) to (4) can be in the free acid form (M=H) or in salt form. M is then an alkali metal ion, especially a sodium or potassium ion, an ammonium ion or an amine salt ion, e.g. of a primary or secondary alkylamine, the alkyl group or groups of which can be substituted by halogen, hydroxyl (e.g. ethanolamine, diethanolamine, triethanolamine) or alkoxy, or of a cyclic amine, e.g. a piperidine, pyrrolidine, piperazine or morpholine.

The acid hydrogen atoms in the phosphoric acid radical X of the compounds of the formula (1) can, if desired, be replaced by the same ions as defined above for M. The radical X is then in salt form.

To increase the stability of the formulations of the invention further it is often advantageous to add one or more additional conventional assistants. Suitable additional assistants of this kind are non-ionic or anionic surfactants, organic solubilisers, and other organic polar compounds.

Examples of organic solubilisers and polar organic compounds which can be used are: lower monohydric alcohols, polyhydric alcohols, ether alcohols, not too high molecular weight polyglycols or carboxamides. Examples of such solvents are: propanol, isopropanol, ethylene glycol, propylene glycol, butylene glycol, glycerol, ethylene glycol monomethyl, monoethyl, monopropyl or monobutyl ether, dipropylene glycol, formamide, dimethyl formamide, dimethyl acetamide and N-methylpyrrolidone. Preferred solvents of this kind are ethylene glycol and N-methylpyrrolidone. Further suitable solubilisers and solvents are amines such as triethanolamines and other water-soluble polar compounds such as dimethyl sulfoxide, dimethyl methanephosphonate, dimethyl sulfone, sulfolane (tetrahydrothiophene-1,1-dioxide), ethylene carbonate or propylene carbonate, and also urea or substituted ureas, e.g. tetramethylurea. Inorganic or organic acids, e.g. hydrochloric acid, acetic acid or formic acid, can also be employed as additional assistants.

Examples of non-ionic surfactants which can be used are: adducts of alkylene oxides, especially of ethylene oxide, with higher fatty acids, fatty acid amides, aliphatic alcohols, mercaptans or amines, with alkylphenols or alkylthiophenols containing at least 7 carbon atoms in the alkyl moieties, or with phenylphenols, e.g. polyglycol-(monoalkylphenyl) ethers containing at least 8 to 12 carbon atoms in the alkyl moiety and at least 8 unsubstituted or substituted glycol units, e.g. decaethylene glycol monooctoylphenyl ether or the reaction product of monononylphenol with 5 to 35 moles of ethylene oxide; copolymers of ethylene oxide and higher alkylene oxides, e.g. propylene oxide or butylene oxide; non-ionic esters of adducts of alkylene oxides, e.g. the tertiary phosphoric acid ester of the adduct of 40 moles of ethylene oxide and monononylphenol; esters of polyalcohols, especially monoglycerides of fatty acids containing 12 to 18 carbon atoms, e.g. the monoglycerides of lauric, stearic or oleic acid; N-acylated alkanolamines of the same type as mentioned for the sulfates of these compounds (see below), e.g. the N,N-bis-($\omega$-hydroxyalkyl)amides of the mixtures of acid collectively known as coconut oil fatty acids, in particular N,N-bis-($\beta$-hydroxyethyl)amide or N,N-bis-($\gamma$-hydroxypropyl)amide, and also the adducts of ethylene oxide with these N-acylated alkanolamines; reaction products of higher fatty acids with an alkanolamine, the molar ratio of alkanolamine to fatty acid being greater than 1, e.g. 2. Suitable fatty acids are, in particular, those containing 8 to 18 carbon atoms, as well as the mixtures known as coconut oil fatty acids. A suitable alkanolamine is, in particular, diethanolamine.

Examples of suitable anionic surfactants which can be used are: sulfated alkylene oxide adducts, especially sulfated ethylene oxide adducts, such as sulfated adducts of 1 to 40 moles of ethylene oxide with fatty acid amides, mercaptans or amines, but in particular with fatty acids, aliphatic alcohols or alkylphenols containing 8 to 20 carbon atoms in the alkyl chain, e.g. with stearic acid, oleic acid, lauryl alcohol, myristyl alcohol, stearyl alcohol, oleyl alcohol, octylphenol or nonylphenol. Instead of the sulfates, it is also possible to use the esters of other polyvalent acids. Such esters comprise e.g. the primary and secondary esters of phosphoric acid as well as the hemiesters of sulfonsuccinic acid; sulfates of N-acylated alkanolamines, e.g. the sulfated amides of caprylic acid, pelargonic acid, capric acid, lauric acid, myristic or stearic acid, or of lower fatty acids substituted by alkylphenoxy groups, e.g. octyl- or nonylphenoxyacetic acid, with mono- or bis-hydroxyalkylamines such as $\beta$-hydroxyethylamine, $\gamma$-hydroxypropylamine, $\beta,\gamma$-dihydroxypropylamine, bis-($\beta$-hydroxyethyl)amine, or with N-alkyl-N-hydroxyalkylamines such as N-methyl- or N-ethyl-N-($\beta$-hydroxyethyl)amine; and sulfated esterified polyoxy compounds, e.g. sulfated, partially esterified polyhydric alcohols, such as the sodium salt of the sulfated monoglyceride of palmitic acid.

The acid phosphoric acid esters of oxyalkylated fatty amines of the formula (1) contained in the formulations of this invention are known and can be easily obtained by esterification of an oxyalkylated fatty amine of the formula

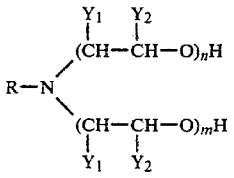

(7)

wherein the general symbols are as defined for formula (1), with phosphoric acid, phosphorus pentoxide or a halide of phosphoric acid. The reaction with phosphorus pentoxide is preferred. The esterification is conveniently carried out by a simple mixing of the reactants with simultaneous heating, e.g. to 50°–100° C. If desired, the acid esters can be converted into the corresponding salts (alkali metal, ammonium or amine salts), e.g. in conventional manner by addition of the appropriate base, e.g. ammonia, monoethanolamine, triethanolamine or an alkali metal hydroxide.

The compound of the formula

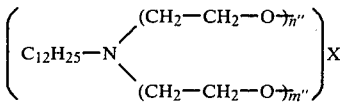

(8)

wherein the sum of n''+m'' is 8 and X is an acid phosphoric acid radical, can be obtained as follows: 914.6 g of the compound of the formula

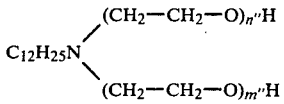

(9)

are put at room temperature into a flask and, with stirring, cooled to 18° C. with a water/ice bath. Then 80.94 g of phosphorus pentoxide are added rapidly. The cooling bath is removed, whereupon the temperature of the yellowish suspension rises to room temperature. The suspension is then heated with an oil bath to 40° C. in the course of 2 hours and to 60° C. in the course of a further 2 hours. The bath is then stirred for 1 hour at 60° C. The resultant product is a yellow, readily pourable gel. The analogous compounds of the formulae (19) to (22) (see the Examples) are also obtained by the above procedure.

The adducts of the formula (7) are known and can be obtained in known manner by addition of 2 to 30 moles of ethylene oxide or propylene oxide to an aliphatic amine containing a hydrocarbon radical of 8 to 22 carbon atoms.

The formulations of the invention are ordinarily obtained by dissolving the appropriate stilbene fluorescent whitening agent of the formula (1) in water or a mixture of water and an additional assistant, with the addition of a compound of the formula (1), if necessary with heating and stirring.

Depending on the nature of the fluorescent whitening agent dissolved therein, the formulations of the invention can be used for whitening a wide range of high molecular weight organic materials. The invention also relates to this utility and to methods of whitening these materials with the formulations employed in the practice of this invention. Examples of suitable substrates to be whitened are man-made, regenerated man-made or natural textiles, paper or detergents. Paper can be whitened direct by addition of the formulations to the pulp, if necessary after addition of assistants customarily employed in paper manufacture.

As the formulations can be very readily and rapidly diluted with water, they are also most suitable for whitening textile substrates by the conventional methods of application (e.g. exhaust method, pad-heat method). To this end, the concentrated formulations are diluted with water such that the application solutions obtained therefrom, to which further conventional assistants can be added, contain the desired concentration of fluorescent whitening agent.

Suitable textile fabrics to be whitened are those made from man-made materials, e.g. polyamide, from regenerated man-made materials, e.g. regenerated cellulose, as well as from natural materials, e.g. wool or cotton, and fibre blends, e.g. polyester/cotton. The natural fabrics can also be finished as is customary in the textile industry.

The textile fabrics to be whitened can be in the most diverse states of processing (raw materials, semi-finished goods or finished goods). Fabrics can be e.g. in the form of staple fibres, flocks, hanks, textile filaments, yarns, threads, nonwovens, felts, waddings, flocked structures, bonded textile fabrics or knitted fabrics. The treatment of these latter is carried out with the dilute solutions employed in the practice of this invention, if necessary or desired after addition of dispersants, stabilisers, wetting agents and further assistants.

Depending on the fluorescent whitening agent dissolved in the formulation, it can be advantageous to carry out the treatment in a neutral, alkaline or acid bath. The treatment is usually carried out in the temperature range from about 20° to 140° C., for example at the boiling point of the bath or near it (about 90° C.).

It is also possible to add the following assistants to the bath: dyes (shading dyes), pigments (coloured or, in particular, e.g. white pigments), carriers, wetting agents, plasticisers, swelling agents, antioxidants, light stabilisers, heat stabilisers, chemical bleaching agents (chlorite bleach, bleaching bath additives), crosslinking agents, finishing agents (e.g. starch or synthetic finishes), as well as agents which are employed in a wide range of textile finishing methods, especially agents for synthetic resin finishes (e.g. creaseproof finishes such as wash-and-wear, permanent press, non-iron), and also flame retardant, soft handle, antisoiling or antistatic finishes or antimicrobial finishes. In certain cases, the fluorescent whitening agents are made fully effective by an aftertreatment. This can be, for example, a chemical treatment (for example acid treatment), a thermal treatment or a combined chemical/thermal treatment. Thus, for example, the appropriate procedure to follow in whitening a number of fibre substrates is to impregnate these fibres with the aqueous solutions at temperatures below 75° C., for example at room temperature, and to subject them to a dry heat treatment at temperatures above 100° C., it being generally advisable additionally to dry the fabric beforehand at moderately elevated temperature, for example in the range from at least 60° C. to about 130° C. The heat treatment in the dry state is then advantageously carried out in the temperature range from 120° to 225° C., for example by heating in a drying chamber, by ironing within the specified temperature range or by treatment with dry, superheated steam. The drying and dry heat treatment can also be carried out in immediate succession or combined in a single procedure.

The concentrated formulations of this invention are diluted to the corresponding application baths in such a manner that, when impregnating the respective substrate, the fluorescent whitening agent exhausts onto this latter in an amount of at least 0.0001% by weight, at most, however, of 2% by weight, preferably from 0.0005 to 0.5% by weight. The required concentration is established in simple manner from the liquor ratio to be employed, the nature of the substrate, and the fluorescent whitening agent dissolved in the formulation.

The aqueous application baths which are used for the treatment of the textile fabrics, and which, as described above, are dilutions of the formulations of the invention, and contain, if desired, further assistants customarily employed in dyeing practice, e.g. those described above, likewise constitute an object of the invention.

The bath to be employed can be prepared by adding the formulation as such, or also the individual components of said formulation, to the bath.

The formulations of the invention can also be added to wash baths or detergents. To wash baths is simply added an amount of the solution which contains the desired concentration of fluorescent whitening agent. The solutions can be added to detergents in any stage of the production of these latter, e.g. to the slurry before the washing powder is atomised or during the preparation of the liquid detergent combinations. Suitable detergents are the known mixtures of active detergents, for example soap in the form of chips and powders, synthetics, soluble salts of sulfonic acid hemiesters of higher fatty alcohols, arylsulfonic acids with higher and/or multiple alkyl substituents, sulfocarboxylic acid esters of medium to higher alcohols, fatty acid acylaminoalkyl- or acylaminoaryl-glycerol sulfonates and phosphoric acid esters of fatty alcohols. Suitable builders which can be used are, for example, alkali metal polyphosphates and polymetaphosphates, alkali metal pyrophosphates, alkali metal salts of carboxymethyl cellulose and other soil redeposition inhibitors, and also alkali metal silicates, alkali metal carbonates, alkali metal borates, alkali metal perborates, nitrilotriacetic acid, ethylenediaminetetraacetic acid, and foam stabilisers such as alkanolamides of higher fatty acids. The detergents can further contain for example: antistatic agents, fat restorative skin protectives such as lanolin, enzymes, antimicrobial agents, perfumes and colourants.

The amount of formulation added to the detergent is calculated such that this latter contains about 0.001 to 0.5% by weight of fluorescent whitening agent, based on the solids content of the detergent.

The formulations of the invention preferably contain 10 to 60 parts by weight of an acid ester of the formula (1), 5 to 30 parts by weight of the respective stilbene fluorescent whitening agent, and 10 to 85 parts by weight of water. Part of the water, but at most one third, can be replaced by one or more optional assistants.

As already mentioned, ion-containing water (i.e. mains water) can be used for preparing the formulations of the invention as well as for diluting these formulations to application baths. Mains water can also be used for application to paper - a factor which is of particular importance in this field. In addition, in a combined whitening and finishing treatment of textile fabrics, in which polymerisation catalysts based on metal salts are used, no impairment of the fluorescent whitening agent and, consequently, of its effectiveness, is observed. All these advantages result from the addition of an acid ester of the formula (1) to the formulations and application baths employed in the practice of this invention.

A number of formulations and their use are described in the following Examples, in which parts and percentages are by weight, unless otherwise indicated. It will be understood that similar formulations can be prepared with the same success using other fluorescent whitening agents of the stilbenesulfonic acid type which are not described in the Examples.

EXAMPLE 1

10 g of the fluorescent whitening agent of the formula

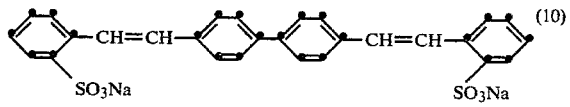

(10)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 2

10 g of the fluorescent whitening agent of the formula (10) and 20 g of the acid ester of the formula (8) are dissolved at 70°-80° C. in 26.5 g of demineralised water with the addition of 10 g of an adduct of 8 moles of ethylene oxide with o-phenylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 3

10 g of the fluorescent whitening agent of the formula

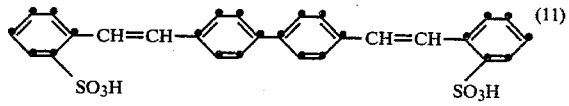

(11)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 4

10 g of the fluorescent whitening agent of the formula

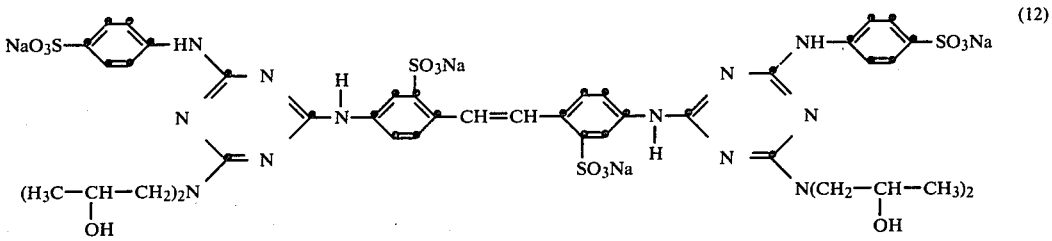

(12)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 5

10 g of the fluorescent whitening agent of the formula

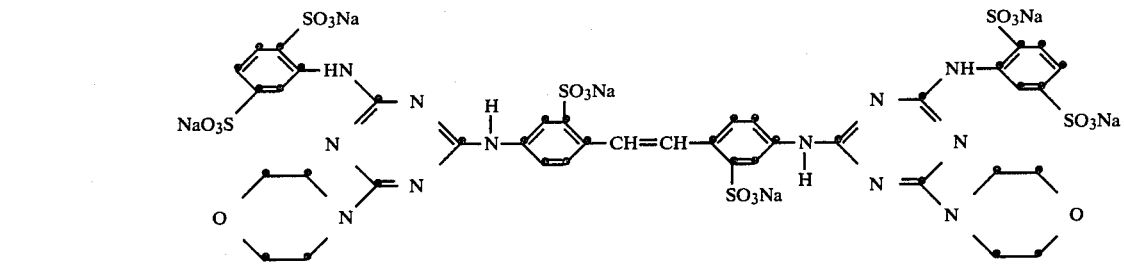

(14)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 7

10 g of the fluorescent whitening agent of the formula

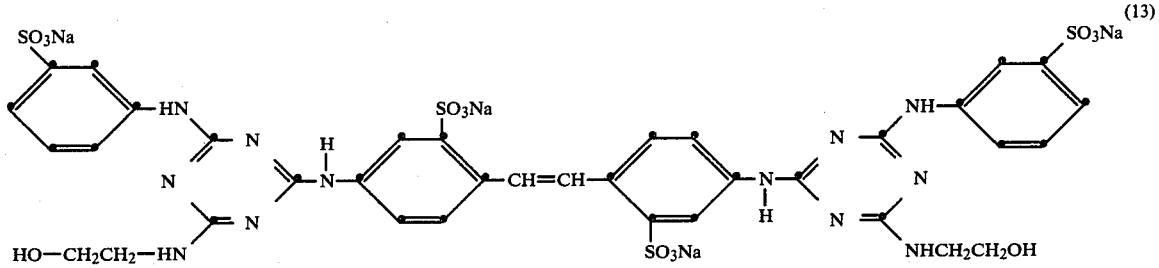

(13)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 6

10 g of the fluorescent whitening agent of the formula (13) and 20 g of the acid ester of the formula (8) are dissolved at 70°-80° C. in 60 g of demineralised water. This formulation can be used e.g. for whitening cotton/polyester, cotton and polyamide, both in hard water and in the presence of metal salt catalysts.

EXAMPLE 8

10 g of the fluorescent whitening agent of the formula (14) and 20 g of the acid ester of the formula (8) are dissolved at 70°-80° C. in 60 g of demineralised water. This formulation can be used e.g. for whitening cotton/polyester, cotton and polyamide, both in hard water and in the presence of metal salt catalysts.

EXAMPLE 9

10 g of the fluorescent whitening agent of the formula

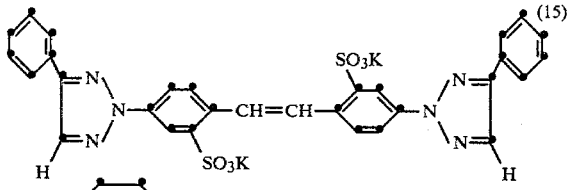

(15)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used e.g. for whitening cotton/polyester, cotton and polyamide, both in hard water and in the presence of metal salt catalysts.

EXAMPLE 10

10 g of the fluorescent whitening agent of the formula

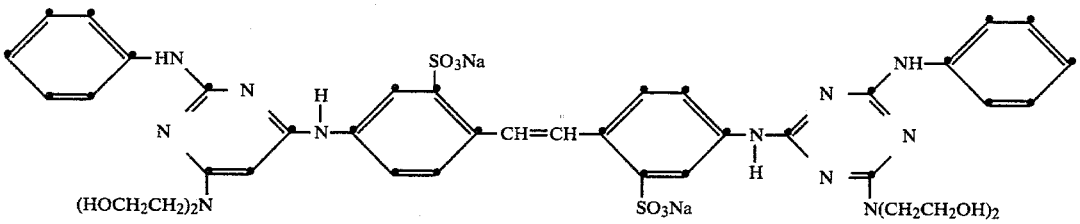

(16)

and 20 g of the acid ester of the formula (8) are dissolved at 70°-80° C. in 26.5 g of demineralised water with the addition of 10 g of an adduct of 9 moles of ethylene oxide with nonylphenol, 15 g of ethylene glycol and 18 g of polyethylene glycol 300. This formulation can be used in particular for whitening paper.

EXAMPLE 11

22 g of the fluorescent whitening agent of the formula

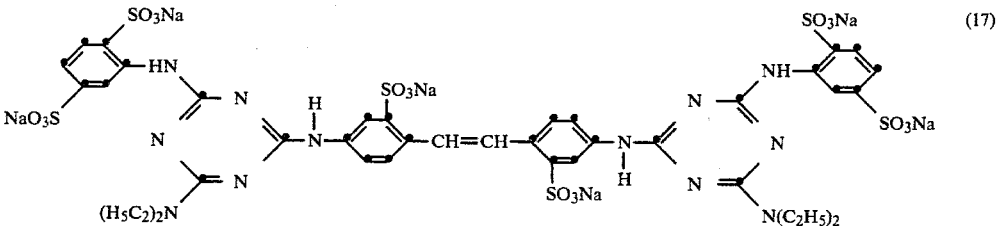

(17)

(active ingredient content: 77.3%) and 17 g of the acid ester of the formula (8) are dissolved at 70°-80° C. in 61 g of demineralised water. The aqueous formulation so obtained is stable to metal ions and metal catalysts.

EXAMPLE 12

11.6 g of the fluorescent whitening agent of the formula

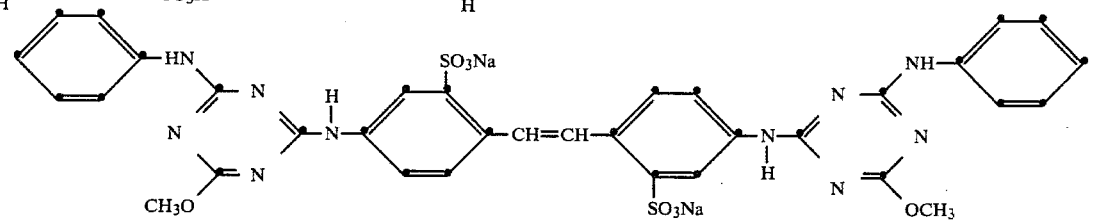

(18)

(active ingredient content: 85.5%) are stirred at 70°-80° C. into a solution of 20 g of the acid ester of the formula (8) in 68.4 g of water, whereby two phases are formed. The lower phase, which contains the fluorescent whitening agent and the compound of the formula (8), is separated, affording 51 g of a clear, amber-coloured solution which contains about 20% of fluorescent whitening agent and which is stable to metal ions and metal catalysts.

EXAMPLE 13

10 g of the fluorescent whitening agent of the formula (10) and 20 g of the acid ester of the formula (19)

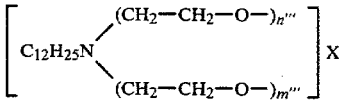

wherein the sum of n''' + m''' is 4 and X is an acid radical of phosphoric acid, are dissolved at 70°-80° C. in 27 g of demineralised water with the addition of 10 g of an adduct of 9 moles of ethylene oxide with nonylphenol, 15 g of ethylene glycol and 18 g of polyethylene glycol 300. The aqueous formulation so obtained is stable to metal ions and metal catalysts.

EXAMPLE 14

The procedure of Example 13 is repeated, using 20 g of the compound of the formula (19), in which the sum of $n''' + m'''$ is 6. The formulation so obtained is likewise stable to metal ions and metal catalysts.

EXAMPLE 15

10 g of the fluorescent whitening agent of the formula (10) and 20 g of the acid ester of the formula (8) are dissolved at 70°–80° C. in 26 g of demineralised water with the addition of 10 g of an adduct of 9 moles of ethylene oxide with nonylphenol, 16 g of tetramethylurea and 18 g of polyethylene glycol 300. The aqueous formulation so obtained is stable to metal ions and metal catalysts.

EXAMPLE 16

The procedure of Example 15 is repeated, using 16 g of sulfolane instead of tetramethylurea. The resultant formulation is likewise stable to metal ions and metal catalysts.

EXAMPLE 17

The procedure of Example 15 is repeated, using 16 g of ethylene carbonate instead of tetramethylurea. The resultant formulation is likewise stable to metal ions and metal catalysts.

EXAMPLE 18

15 g of the fluorescent whitening agent of the formula (10) and 30 g of the acid ester of the formula (8) are dissolved at 70°–80° C. in 35 g of demineralised water with the addition of 20 g of ethylene carbonate. The aqueous formulation so obtained is stable to metal ions and metal catalysts.

EXAMPLE 19

15 g of the fluorescent whitening agent of the formula (10) and 30 g of the acid ester of the formula (8) are dissolved at 70°–80° C. in 50 g of demineralised water with the addition of 5 g of sulfolane. The aqueous formulation so obtained is stable to metal ions and metal catalysts.

EXAMPLE 20

15 g of the fluorescent whitening agent of the formula (10) and 30 g of the acid ester of the formula (8) are dissolved at 70°–80° C. in 50 g of demineralised water with the addition of 5 g of tetramethylurea. The formulation so obtained is stable to metal ions and metal, catalysts.

EXAMPLE 21

10 g of the fluorescent whitening agent of the formula (10) and 20 g of the acid ester of the formula

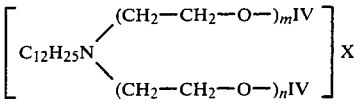

(20)

wherein the sum of $n^{IV} + m^{IV}$ is 12 and X is an acid radical of phosphoric acid, are dissolved at 70°–80° C. in 27 g of demineralised water with the addition of 10 g of an adduct of 9 moles of ethylene oxide with nonylphenol, 15 g of ethylene glycol and 18 g of polyethylene glycol 300. The aqueous formulation so obtained is stable to metal ions and metal catalysts.

EXAMPLE 22

10 g of the fluorescent whitening agent of the formula (10) and 30 g of the acid ester of the formula

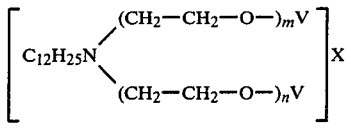

(21)

wherein the sum of $n^{V} + m^{V}$ is 20 and X is an acid radical of phosphoric acid, are dissolved at 70°–80° C. in 17 g of demineralised water with the addition of 10 g of an adduct of 9 moles of ethylene oxide with nonylphenol, 15 g of ethylene glycol and 18 g of polyethylene glycol 300. The aqueous formulation so obtained is stable to metal ions and metal catalysts.

EXAMPLE 23

10 g of the fluorescent whitening agent of the formula (10) and 30 g of the acid ester of the formula

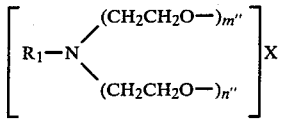

(22)

wherein the sum of $n'' + m''$ is 8 and $R_1$ is the hydrocarbon radical of tallow fatty amine, are dissolved at 70°–80° C. in 17 g of demineralised water with the addition of 10 g of an adduct of 9 moles of ethylene oxide with nonylphenol, 15 g of ethylene glycol and 18 g of polyethylene glycol 300. The aqueous formulation so obtained is stable to metal ions and metal catalysts.

EXAMPLE 24

11.4 g of the fluorescent whitening agent of the formula

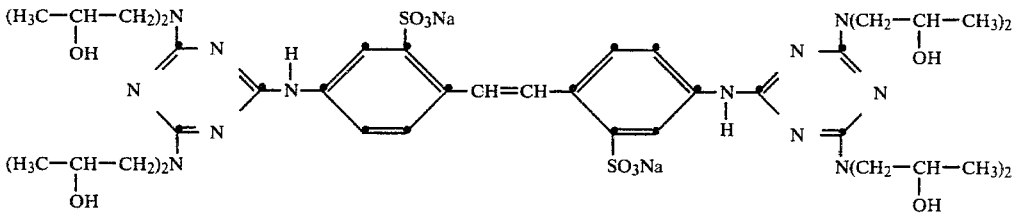

(23)

(active ingredient content: 87%) and 20 g of the acid ester of the formula (8) are dissolved at 70°-80° C. in 62.6 g of demineralised water with the addition of 6 g of dimethylmethanephosphonate. The aqueous formulation so obtained is stable to metal ions and metal catalysts.

EXAMPLE 25

11.4 g of the fluorescent whitening agent of the formula (23) (active ingredient content 87%) and 20 g of the acid ester of the formula (8) are dissolved at 70°-80° C. in 38.6 g of water with the addition of 30 g of sulfolane. The aqueous formulation so obtained is stable to metal ions and metal catalysts.

EXAMPLE 26

11.4 g of the fluorescent whitening agent of the formula (23) (active ingredient content 87% ) and 20 g of the acid ester of the formula (8) are dissolved at 70°-80° C. in 38.6 g of water with the addition of 30 g of ethylene carbonate. The aqueous formulation so obtained is stable to metal ions and metal catalysts.

EXAMPLE 27

12.2 g of the fluorescent whitening agent of the formula

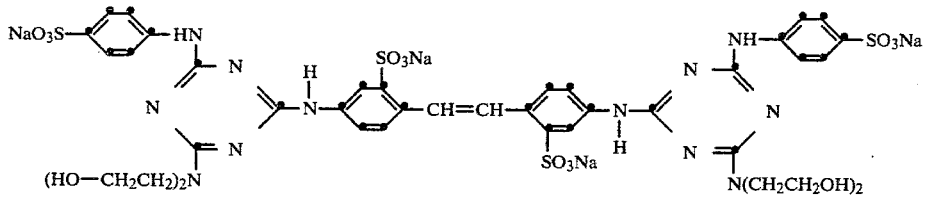

(24)

(active ingredient content: 81.9%) and 20 g of the acid ester of the formula (8) are dissolved at 70°-80° C. in 24.8 g of demineralised water with the addition of 10 g of an adduct of 9 moles of ethylene oxide with nonylphenol, 15 g of ethylene glycol and 18 g of polyethylene glycol 300. The aqueous formulation so obtained is stable to metal ions and metal catalysts.

The stable formulations obtained in Examples 11 to 27 can be used e.g. for whitening cotton/polyester, cotton and polyamide and also paper, both in hard water and in the presence of metal salt catalysts.

EXAMPLE 27a (A) 22 g of the fluorescent whitening agent of the formula (17) and 10.2 g of the acid ester of the formula (22) are dissolved at 70°-80° C. in 67.8 g of demineralised water.

(B) 22 g of the fluorescent whitening agent of the formula (17) and 10.2 g of the acid ester of the formula (20) are dissolved at 70°-80° C. in 67.8 g of demineralised water.

(C) 22 g of the fluorescent whitening agent of the formula (17) and 10.2 g of the acid ester of the formula (21) are dissolved at 70°-80° C. in 67.8 g of demineralised water. Each of the three aqueous formulations so obtained is stable to metal ions and metal catalysts and can be used with advantage for whitening pulp.

EXAMPLE 28

A bath is prepared which contains, per liter of hard water, 1 g of the formulation of Example 1 and 5 g of sodium sulfate. Cotton fabric is put into this bath at 20° C. and at a liquor ratio of 1:25. The bath is then heated to 50° C. in the course of 15 minutes and kept at this temperature for a further 15 minutes. The treated fabric is rinsed for 30 seconds in running cold water and then dried with an iron at 150° C. A pronounced white effect is obtained on the treated fabric. Similar effects are also obtained if a metal salt catalyst is present in the bath.

Similarly good white effects are obtained on cotton fabric if an equivalent amount of each of the formulations of Examples 2 to 9 and 12 to 26 is used instead of the formulation of Example 1 in the above procedure. If a polyester/cotton blend is used, the amount of fluorescent whitening agent is adjusted to the proportion of cotton in the blend.

EXAMPLE 29

A bath is prepared which contains, per litre of hard water, 1 g of the formulation of Example 1 and 3 g of a mixture of sodium hydrosulfite and sodium pyrophosphate. Polyamide 6.6 woven tricot fabric is put into this bath at 40° C. and at a liquor ratio of 1:20. The bath is heated to 97° C. in the course of 30 minutes, kept at this temperature for 30 minutes, and then cooled to 40° C. in the course of 15 minutes. The treated fabric is rinsed for 30 seconds in running cold water and then dried with an iron at 180° C. A pronounced white effect is obtained on the treated fabric. Similar effects are also obtained if a metal catalyst is present in the bath. Similarly good white effects are obtained on polyamide 6.6 fabric if an equivalent amount of each of the formulations of Examples 2 to 9 and 12 to 26 is used instead of the formulation of Example 1 and the above procedure is repeated.

EXAMPLE 30

A cotton fabric is padded at 20° C. to a pick-up of 75% with a hard water liquor which contains 10 g/l of the formulation of Example 1. The treated fabric is then dried for 30 seconds at 130° C. A pronounced white effect is obtained on the treated fabric. Similarly good white effects are obtained on cotton fabric if an equivalent amount of each of the formulations of Examples 2 to 9 and 12 to 26 is used instead of the formulation of Example 1 and the above procedure is repeated.

EXAMPLE 31

Polyamide 6.6 woven tricot fabric (non-fixed) is padded at 20° C. to a pick-up of 110% with a hard water liquor which contains 10 g/l of the formulation of Example 1, 2 g of sodium hexametaphosphate and 15 g of a polyethylene glycol having a molecular weight of about 600, and 5 ml of 80% acetic acid. The treated fabric is then thermofixed for 40 seconds at 190° C. A pronounced white effect is obtained on the treated fabric. Similarly good white effects are obtained on polyamide 6.6 fabric if an equivalent amount of each of the formulations of Examples 2 to 9 and 12 to 26 is used instead of the formulation of Example 1 and the above procedure is repeated.

EXAMPLE 32

50 g of bleached cellulose (10% suspension) are stirred in a metal beaker with 99 ml of water and 1 ml of a 10% aluminium sulfate solution. After 2 minutes, 7.5 ml of a 10% filler suspension (kaolin) are added, followed by the addition after 10 minutes of 0.036 g of a formulation of Example 10, 11, 27 or 27a. At further 2 minute intervals, 2 ml of 5% resin size solution and 1.5 ml of a 10% aluminium sulfate solution are added. After bulking with water to 500 ml, the resultant suspension is put into a mixing beaker, bulked with water to 1000 ml, and mixed for 2 seconds. The pulp is processed to paper sheets, including pressing and drying, in known manner. A pronounced white effect of good lightfastness is obtained on the paper in all four experiments.

EXAMPLE 33

50 g of bleached cellulose (10% suspension) are stirred in a metal beaker with 99 ml of water and 1 ml of a 10% aluminium sulfate solution. After 2 minutes, 7.5 ml of a 10% filler suspension (kaolin) are added, followed by the addition after 10 minutes of 0.1 g of the formulation of Example 1. At further 2 minute intervals, 2 ml of 5% resin size solution and 1.5 ml of a 10% aluminium sulfate solution are added. After bulking with water to 500 ml, the resultant suspension is put into a mixing beaker, bulked with water to 1000 ml, and mixed for 2 seconds. The pulp is processed to paper sheets, including pressing and drying, in known manner. A pronounced white effect of good lightfastness is obtained on the paper.

Similarly good white effects are obtained on paper by using corresponding amounts of the formulations of Examples 10, 11, 27 or 27a and repeating the above procedure.

What is claimed is:

1. A storable aqueous formulation which is stable to metal ions, said formulation containing a fluorescent whitening agent which is substituted by sulfo groups, and an acid phosphoric acid ester of an oxyalkylated fatty amine of the formula

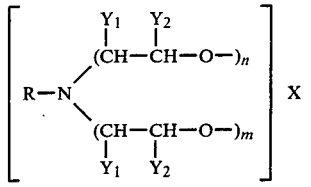

or an alkali metal salt, ammonium salt or amine salt thereof, wherein R is an aliphatic hydrocarbon radical of 8 to 22 carbon atoms, $Y_1$ and $Y_2$ are both hydrogen, or one of $Y_1$ and $Y_2$ is hydrogen and the other is methyl, X is the acid radical of phosphoric acid, the acid hydrogen atoms of which radical can be replaced by alkali metal ions, ammonium ions or amine salt ions, and m and n are integers, the sum of which is 2 to 30.

2. A formulation according to claim 1 which contains an acid phosphoric acid ester of an oxyalkylated fatty amine of the formula

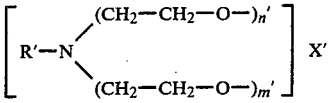

wherein R′ is an alkyl or alkenyl radical of 10 to 18 carbon atoms, X′ is the acid radical of phosphoric acid, the acid hydrogen atoms of which radical can also be replaced by alkali metal ions or ammonium ions, and n′ and m′ are integers, the sum of which is 4 to 20.

3. A formulation according to claim 2, which comprises the use of an acid phosphoric acid ester of an oxyalkylated fatty amine, wherein R′ is the lauryl radical, the sum of n′+m′ is 6 to 8, and the phosphoric acid radical is not in salt form.

4. The formulation according to claim 1 which contains a fluorescent whitening agent of the bis-triazinylaminostilbene-disulfonic acid type, of the bis-styrylbiphenyl type, or of the bis-triazolylstilbene-disulfonic acid type.

5. A formulation according to claim 4 which contains a stilbene fluorescent whitening agent of the formula

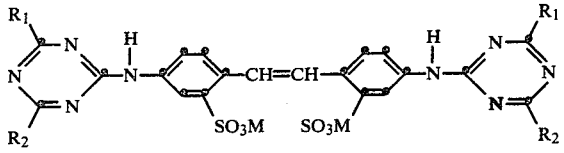

wherein $R_1$ and $R_2$ are $NH_2$, $NH—CH_3$, $NH—C_2H_5$, $N(CH_3)_2$, $N(C_2H_5)_2$, $NH—CH_2CH_2OH$, $NH—CH_2—CH_2CH_2—OH$, $N(CH_2—CH_2—OH)_2$, $N(CH_2—CH-$ $_2$—$CH_2$—OH)$_2$, N($CH_3$)($CH_2$—$CH_2$OH), NH—$CH_2$C-$H_2$—O—$CH_2$—$CH_2$—OH, NH—$CH_2$—$CH_2$—$SO_3$M, OH, $OCH_3$, OCH($CH_3$)$_2$, O—$CH_2$—$CH_2$—O—$CH_3$,

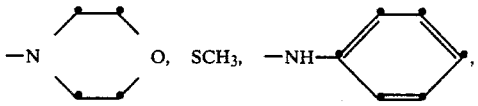

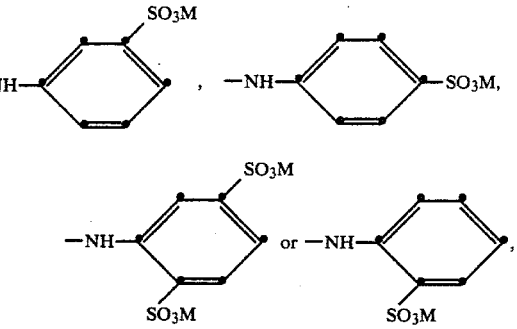

and M is hydrogen, an alkali metal ion, an ammonium ion or an amine salt ion; or of the formula

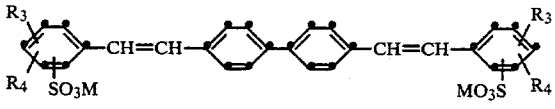

wherein $R_3$ is hydrogen, alkyl of 1 to 4 carbon atoms, alkoxy of 1 to 4 carbon atoms, halogen or $SO_3M$, $R_4$ is hydrogen or alkyl of 1 to 4 carbon atoms, and M is hydrogen or an alkali metal ion, ammonium ion or amine salt ion; or of the formula

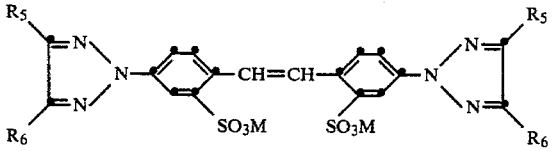

wherein M is hydrogen, an alkali metal ion, ammonium ion or amine salt ion, and each of $R_5$ and $R_6$ independently is hydrogen, $CH_3$,

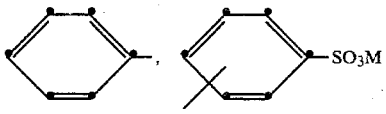

or $R_5$ and $R_6$ together complete a benzene ring.

6. A formulation according to claim 5 which contains a stilbene fluorescent whitening agent of the formula

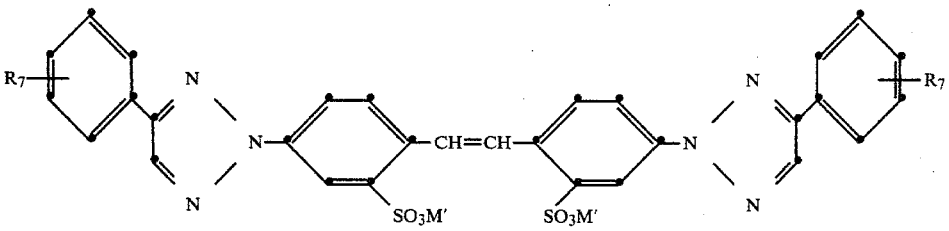

wherein $R_7$ is hydrogen or —$SO_3M'$, and M' is hydrogen, or a sodium, potassium, ammonium or amine salt ion.

7. A formulation according to claim 5 which contains a stilbene fluorescent whitening agent of the formula

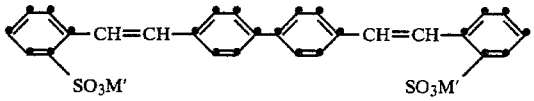

wherein M' is hydrogen or a sodium, potassium, ammonium or amine salt ion.

8. A formulation according to claim 1 which additionally contains one or more assistants, for example selected from the class of compounds comprising non-ionic or anionic surfactants, organic solubilisers and polar organic compounds or mixtures thereof.

9. A formulation according to claim 8, wherein the assistant is one or more of a hydrophilic organic solvent such as a lower monohydric alcohol, a polyhydric alcohol, an ether alcohol, a glycol, polyglycol, glycol ether or polyglycol ether, an amide or amine, or a polar organic compound such as dimethyl sulfoxide, dimethyl methanephosphonate, dimethyl sulfone, sulfolane, ethylene carbonate or propylene carbonate, urea or a substituted area.

10. A formulation according to claim 8, wherein the assistant is one or more of a non-ionic surfactant such as an adduct of an alkylene oxide with a higher fatty acid, fatty acid amide, aliphatic alcohol, mercaptan or amine, with an alkylphenol, alkylthiophenol or phenylphenol, a copolymer of ethylene oxide and a higher alkylene oxide, a non-ionic ester of an adduct of an alkylene oxide, an ester of a polyalcohol, a N-acylated alkanolamine or an adduct thereof with ethylene oxide, and a reaction product of a higher fatty acid with an alkanolamine or an anionic surfactant such as an alkylene oxide adduct containing sulfate or other acid radicals, a sulfate of a N-acylated alkanolamine, or a sulfated esterified polyoxy compound.

11. A method of whitening natural and synthetic fabrics, which comprises treating, for example by the exhaust process, said fabrics with a liquor which contains a formulation as claimed in claim 1.

12. A method according to claim 11, wherein the fabrics to be whitened are polyamide, cellulose, and blends of polyester and cellulose or wool.

13. A method of whitening paper, which comprises adding to the pulp a formulation as claimed in claim 1.

14. An aqueous bath for whitening natural and synthetic fabrics, which contains an effective amount of a formulation as claimed in claim 1.

* * * * *